US006884118B2

(12) United States Patent
Street et al.

(10) Patent No.: US 6,884,118 B2
(45) Date of Patent: Apr. 26, 2005

(54) LEAD ALIGNING TERMINAL

(75) Inventors: Steven Street, Chicago, IL (US); Ismael Garcia, Chicago, IL (US)

(73) Assignee: Christiana Industries, LLC, Vernon Hills, IL (US)

( * ) Notice: Subject to any disclaimer, the term of this patent is extended or adjusted under 35 U.S.C. 154(b) by 100 days.

(21) Appl. No.: 10/461,294

(22) Filed: Jun. 13, 2003

(65) Prior Publication Data

US 2004/0253872 A1 Dec. 16, 2004

(51) Int. Cl.[7] ..... H01R 17/00
(52) U.S. Cl. ..... 439/619; 439/699.2; 439/374
(58) Field of Search ..... 439/619, 699.2, 439/857, 856, 374, 862

(56) References Cited

U.S. PATENT DOCUMENTS

| | | | | |
|---|---|---|---|---|
| 4,894,027 A | | 1/1990 | Brantingham et al. | |
| 5,558,543 A | * | 9/1996 | Takano et al. | 439/699.2 |
| 5,876,249 A | * | 3/1999 | Kim | 439/619 |
| 6,217,387 B1 | * | 4/2001 | Sawada et al. | 439/619 |
| 6,315,611 B1 | * | 11/2001 | Sawada et al. | 439/619 |

* cited by examiner

*Primary Examiner*—Gary Paumen
(74) *Attorney, Agent, or Firm*—Greer, Burns & Crain, Ltd

(57) ABSTRACT

A lead aligning terminal for receiving a lamp with a exterior electrical lead comprises at least one contact blade, the blade carrying an elongate lead guide that is adapted to receive the electrical lead, and if it is bent, straighten the same as the lamp is being inserted into the terminal. The lead guide may comprise a slot, a keyhole slot, channel, groove, rib or a plurality of parallel ribs.

6 Claims, 4 Drawing Sheets

LEAD ALIGNING TERMINAL

BACKGROUND OF THE INVENTION

The present invention relates to lamp socket terminals, and in particular to terminals for lamps having exterior electrical lead wires.

Lamps having exterior electrical lead wires are well known in the art. In particular, wedge base lamps comprise a bulb having one or more filaments, a base, and a plurality of exterior electrical leads. The electrical leads conventionally extend out of the lamp from the bottom edge of the lamp base and wrap upwardly along the side of the base, at least one lead on each side of the base. Lamps with a single filament typically have two leads; lamps with more than one filament will have additional leads.

In many conventional lamps, including glass base lamps, the leads are secured to the lamp only at the bottom of the lamp base. As a result, the upper portion of electrical leads often become bent to either the left or right. Bent leads can lead to poor, intermittent or failed contact with the corresponding terminal into which the bulb is inserted.

SUMMARY OF THE INVENTION

To address the above noted issue, an improved terminal is provided. The terminal of the invention is adapted for receiving a lamp having a base and an electrical lead extending from the base, the terminal comprising at least one terminal blade adapted to receive and make electrical contact with the electrical lead, and an elongate lead guide on the blade. The lead guide preferably comprises a slot, such as a keyhole slot, or alternatively, a groove, channel, rib, or plural ribs on the terminal. The lead guide extends longitudinally on the terminal and has an outer end and an inner end, the outer end preferably being wider than the inner end.

In one preferred embodiment the terminal comprises, at least one contact blade extending in a longitudinal direction, the contact blade having an outer end and an inner end. The blade has a flared portion on its outer end and a contact portion inwardly adjacent to the flared portion. The blade further comprises a slot extending longitudinally from the flared portion to the contact portion of the blade. The slot is wider in the flared portion and comparatively narrower in the contact portion. Preferably the slot extends only partly into the contact portion of the blade.

When a lamp is inserted into the terminal, the electrical lead of the lamp is directed into the lead guide. If the lead is bent, the guide operates to straighten the lead. As the bulb is inserted into the terminal, the guide rides over the lead moving the lead into alignment with the terminal. As the bulb base reaches its fully inserted position the guide preferably disengages so that the contact portion of the blade bears against lead making a positive connection.

DETAILED DESCRIPTION OF A PREFERRED EMBODIMENT

Turning now to the drawings, a preferred embodiment of the invention is shown and described below that is presently deemed by the inventors to be the best mode for carrying out the invention. However, it is to be understood that this embodiments is merely illustrative of the invention, is not to be construed as limiting the invention defined by the appended claims, and that the invention may take form in other embodiments as will be apparent to those skilled in the art.

Figure 1:
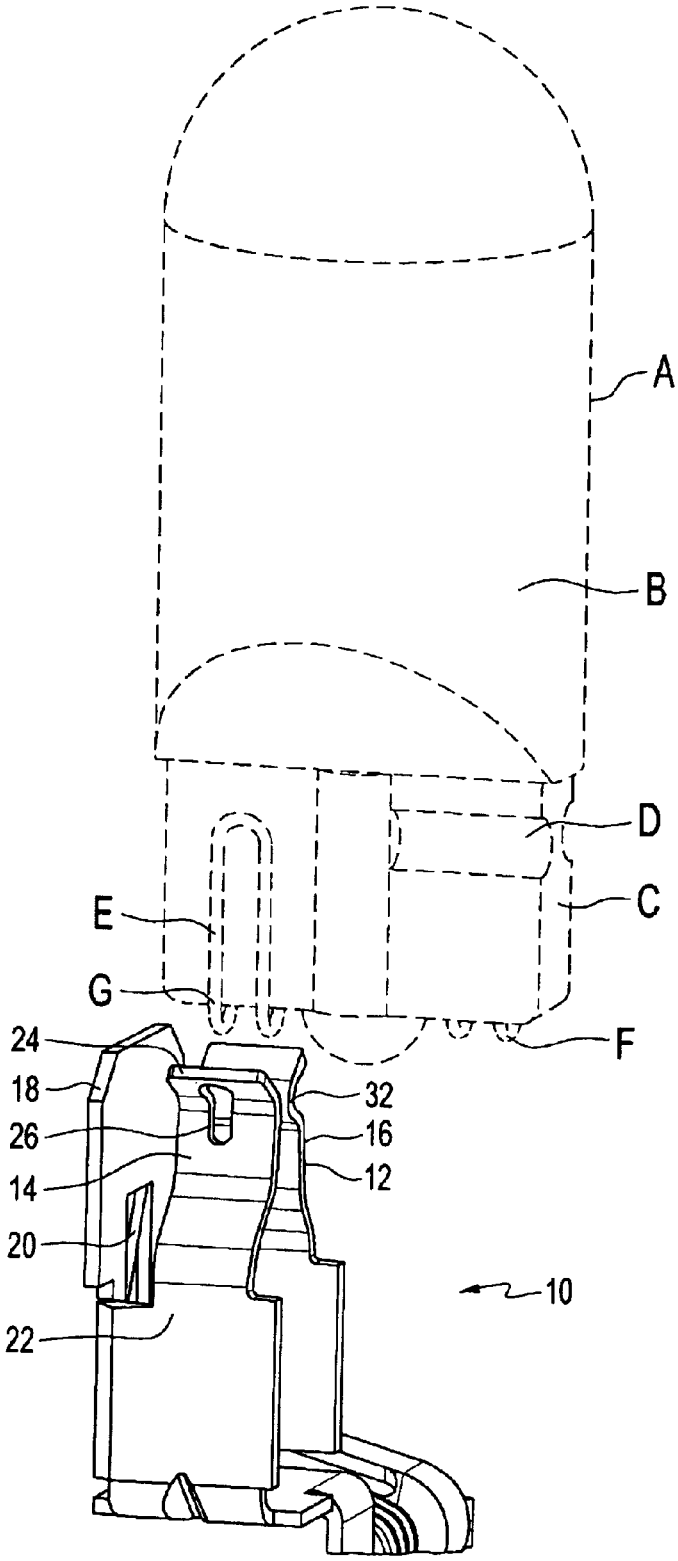
FIG. 1 is an exploded perspective view of a wedge base lamp and a preferred embodiment of the terminal of the invention.
Figure 2:
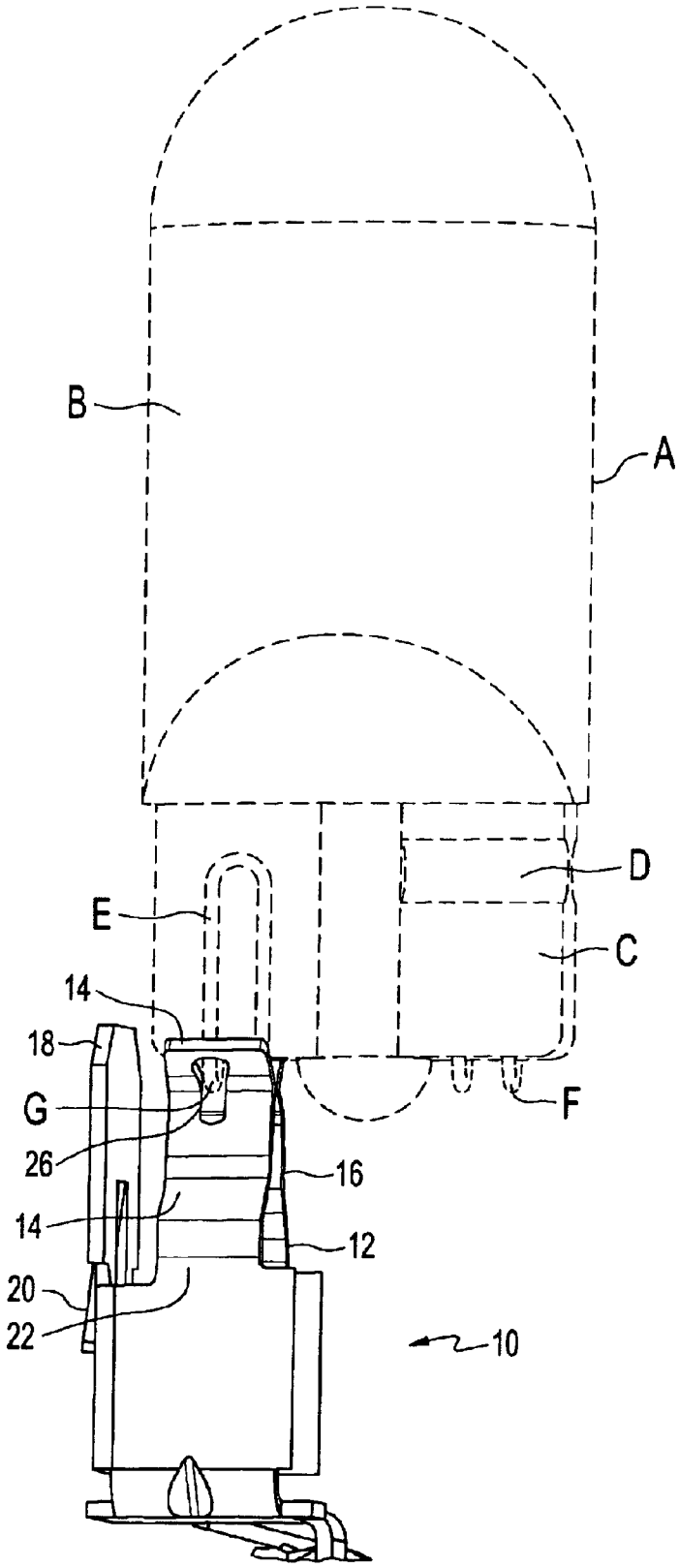
FIG. 2 is a perspective view of the preferred embodiment with the lamp partly inserted into the terminal.

Wedge base lamps A are well known in the art, and comprise a bulb B having one or more filaments (not shown), a base C having a retention groove D, and electrical leads E and F. The electrical leads conventionally extend out of the lamp from the bottom edge of the lamp base and wrap upwardly along the side of the lamp, at least one lead on each side of the base. Lamps with a single filament typically have two leads; lamps with more than one filament will have additional leads. Twin leads E as shown in FIGS. 1 and 2 are known to provide improved contact and electrical connection.

In many conventional lamps, in particular, glass base lamps, the electrical leads are secured to the lamp only at the bottom of the lamp base. As a result, the leads often become bent to either the left or right. Bent leads can cause poor, intermittent or failed contact with the corresponding terminal into which the bulb is inserted.

A preferred embodiment of a lead aligning terminal of the invention is generally designated by reference numeral 10. The terminal 10 comprises lamp receiving end 12 having a contact blade 14, a retaining blade 16, and an alignment plate 18 having a locking tab 20. The contact blade 14 extends in a longitudinal direction from an inner end 22 to an outer end 24. The contact blade includes an elongate lead guide 26. Guide 26 in the preferred embodiment comprises a slot. However, alternate elongate lead guides can be used, such as a groove, a channel, a single rib, or plural parallel ribs. Contact blade 14 further comprises a flared portion 28 on its outer end and a contact portion 30 inwardly adjacent to the flared portion. Retaining blade 16 includes a projection 32 for engaging the lamp base.

Figure 3:
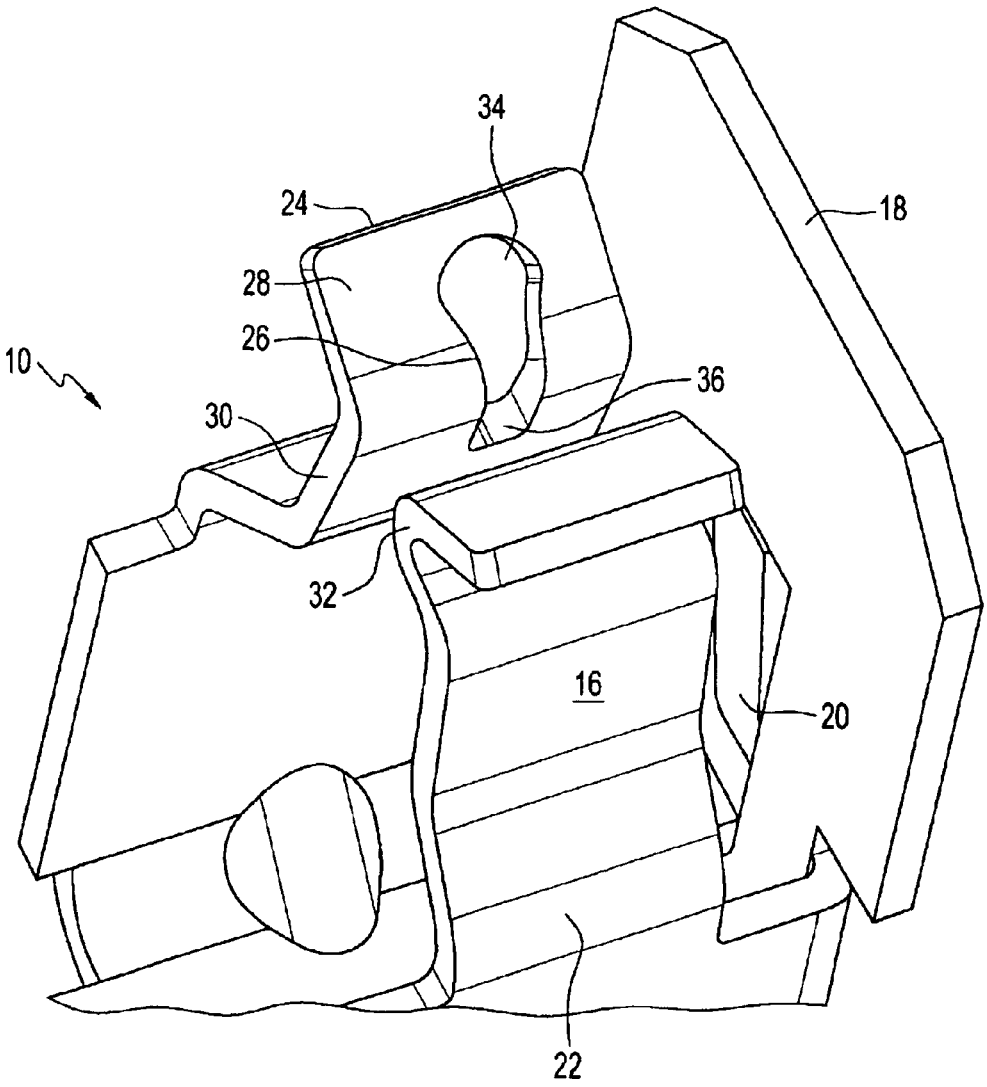
FIG. 3 is a close up perspective view of the preferred embodiment.
Figure 4:
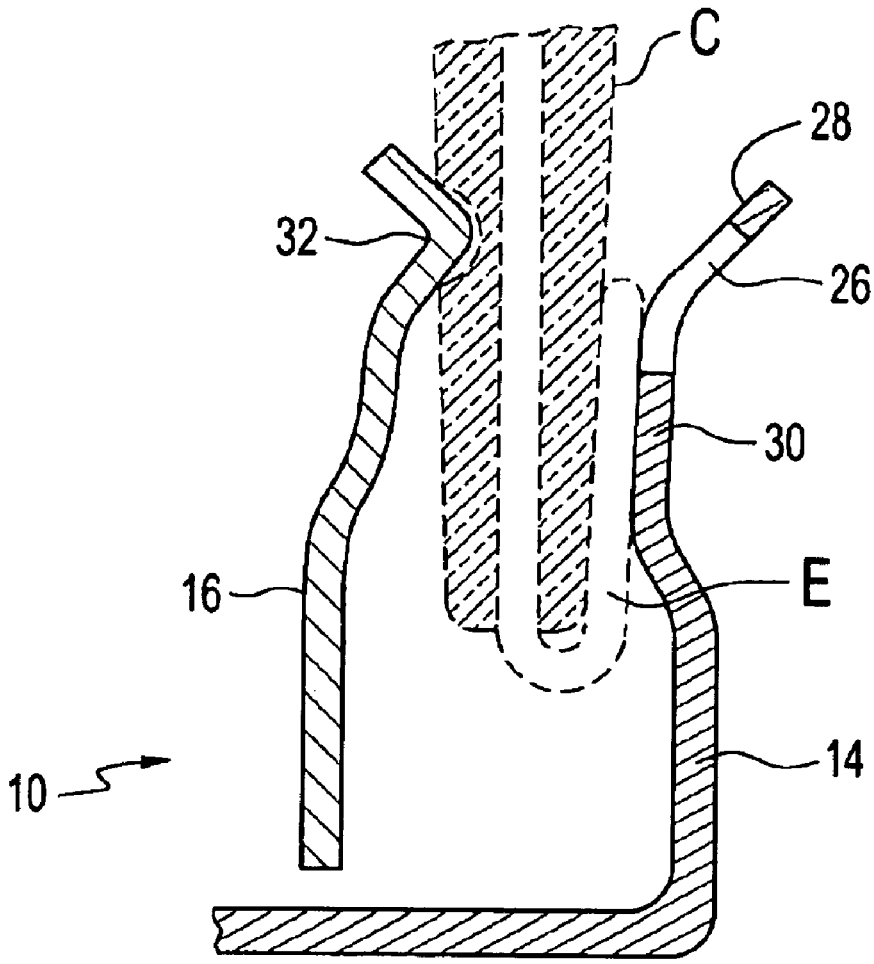
FIG. 4 is a cross-sectional view of the preferred embodiment showing the lamp inserted into the terminal.

The lead guide 26 preferably starts near the outer end of the contact blade in the flared portion 28 and extends longitudinally inward into the contact portion 30 of the blade. However, it extends only partly into the contact portion so that when the lamp is seated, the contact portion 30 of the terminal is firmly pressed against the lamp lead E, as best seen in FIG. 4. It is preferred that the lead guide 26 is wider at its outer end 34, and comparatively narrower at its inner end 36. One preferred configuration is a keyhole slot with the wider portion at the outer end 34, as shown in FIG. 3.

The terminal blades 14,16 are separated progressively as the lamp base is inserted into the terminal. The bottom of the electrical lead G is directed into the lead guide 26, as best seen in FIG. 2. If the lead is bent, the guide operates to straighten the lead as the bulb is inserted into the terminal, and the guide rides over the lead. As the bulb base reaches its fully inserted position the guide preferably disengages from the lead, and the contact portion 30 of the blade presses against lead making a positive connection, as shown in FIG. 4. On the other side of the base, the projection 32 seats with the lamp base groove D, thereby retaining the lamp in the terminal.

Preferably the elongate lead guide 26 is slightly wider than the terminal wire, at least at the outer end of the guide.

However, other widths could be used as may be desired. The horizontal dimension of the guide 26 relative to alignment plate 18 is slightly greater than the horizontal dimension between the edge of the lamp base and the filament lead. Thereby, the guide is located in a position to receive the bottom of the lead when the lamp is inserted into the terminal.

In the preferred embodiment, the lead guide of the invention is incorporated into a terminal for a W-2 wedge base lamp socket. However, it is contemplated, within the scope of the invention, as defined in the appended claims, that the lead guide could be utilized on all types of terminals for various lamps, including for example T1¾ lamps, or any lamps with unanchored leads. Further, although the lead guide is shown on one blade of the terminal, it could be used on both blades of a two blade terminal.

While a particular embodiment of the lead aligning terminal has been shown and described, it will be appreciated by those skilled in the art that changes and modifications may be made thereto without departing from the scope of the invention as set forth in the following claims.

What is claimed is:

1. In a terminal for receiving a lamp having a base and an electrical lead extending from the base, which may or may not be aligned with the terminal, the improvement comprising, an elongate lead guide on the terminal effective when the lamp base is being inserted into the terminal for engaging the electrical lead, and, if it is not aligned with the terminal, for moving the lead into alignment with the terminal said league guide extending longitudinally on said terminal and having an outer end and an inner end, said outer end being wider than said inner end.

2. In a terminal as set forth in claim 1, said lead guide comprises one of a slot, groove, channel, rib, or plural ribs on said terminal.

3. A terminal for a wedge base lamp having a base with at least one electrical lead extending from a bottom of the base and being bent upwardly along one side surface of the base adjacent one end of the base, comprising, a lamp receiving end of the terminal having a pair of opposed blades, at least one of the blades being a contact blade adapted for making electrical contact with at least one of the electrical leads of the lamp, and an elongate, longitudinal lead guide on said contact blade, said guide having an outer end and an inner end, said guide being wider at its outer end as compared to its inner end.

4. A terminal as in claim 3, wherein said lead guide comprises a keyhole slot.

5. A terminal comprising, at least one contact blade extending in a longitudinal direction, said contact blade having an outer end and an inner end, said blade having a flared portion on its outer end and a contact portion inwardly adjacent to said flared portion, said blade further comprising a slot extending longitudinally from said flared portion to said contact portion of said blade, said slot being wider in said flared portion and comparatively narrower in said contact portion.

6. A terminal as in claim 5 wherein said slot extends only partly into said contact portion of said blade.

* * * * *